United States Patent [19]

Nelson et al.

[11] Patent Number: 4,906,262

[45] Date of Patent: Mar. 6, 1990

[54] SELF CLEANING ROTARY SCREEN FOR THE COOLING AIR INLET OF AN ENGINE ENCLOSURE

[75] Inventors: James R. Nelson; Mahlon L. Love, both of Geneseo, Ill.

[73] Assignee: Deere & Company, Moline, Ill.

[21] Appl. No.: 240,415

[22] Filed: Sep. 1, 1988

Related U.S. Application Data

[63] Continuation of Ser. No. 43,915, Apr. 29, 1987, abandoned.

[51] Int. Cl.[4] ..... B01D 46/38

[52] U.S. Cl. ..... 55/290; 55/267; 55/400

[58] Field of Search ..... 55/290, 400, 267

[56] References Cited

U.S. PATENT DOCUMENTS

| | | | |
|---|---|---|---|
| 3,327,457 | 6/1967 | Liusl | 55/290 |
| 3,816,981 | 6/1974 | Carnewal et al. | 55/290 |
| 3,837,149 | 9/1974 | West et al. | 55/290 |
| 4,217,119 | 8/1980 | Furstenberg | 55/351 |
| 4,233,040 | 11/1980 | Vogelaar et al. | 55/385 B |
| 4,542,785 | 9/1985 | Bagnall et al. | 165/95 |

FOREIGN PATENT DOCUMENTS

| | | |
|---|---|---|
| 498977 | 3/1979 | Australia . |
| 1407943 | 10/1969 | Fed. Rep. of Germany . |

*Primary Examiner*—Bernard Nozick

[57] ABSTRACT

A self cleaning rotary screen of an agricultural combine is provided with a planar circular screen that is secured to an outwardly extending circular flange having an external groove and an internal groove. The screen is rotatably coupled to a pivotable door by a plurality of freely rotatable wheels which engage the internal groove of the flange. Also secured to the door are two freely rotatable idler sheaves located adjacent to the pivot axis of the door so that the centerpoint of the endless belt when coupled to the outer periphery of the sheaves forms a tangent axis that is substantially aligned with the pivot axis of the door. A driving sheave is operatively coupled to the propulsion system of the combine and is provided with a central rotational axis that intersects the tangent axis of the idler sheaves.

21 Claims, 3 Drawing Sheets

SELF CLEANING ROTARY SCREEN FOR THE COOLING AIR INLET OF AN ENGINE ENCLOSURE

This application is a continuation of application Ser. No. 043,915, filed Apr. 29, 1987 now abandoned.

BACKGROUND OF THE INVENTION

1. Field of the Invention

The invention is directed to a self-cleaning rotary screen through which cooling air is drawn for cooling an internal combustion engine on an agricultural combine.

2. Description of the Prior Art

In recent years, it has become common practice to enclose the engines of self-propelled agricultural combines. Typically, these enclosures are provided with self-cleaning rotary screens through which a cooling air stream is drawn. Heat exchangers are located behind the screen and include the radiator for cooling the engine, the oil cooler, and the condenser coils for the air conditioning. The screen is used to remove chaff and leaves from the cooling air stream so that they do not block the various heat exchangers located behind the screen.

It is desirable that the screen be automatically and continuously self cleaning to facilitate air flow through the screen. One method of accomplishing this task is to rotate the screen through a stationary chamber which is used to vacuum the trash accumulated on the screen. This stationary chamber maybe pneumatically coupled to the cooling air stream downstream of heat exchangers for reintroducing the trash collected off the screen into the air stream.

The screen maybe operatively coupled to a driving sheave of the propulsion means of the combine, by an endless belt that encircles a flange on the screen. Typically the screen is provided with a central hub on which it is rotated which also serves as a mounting point for the stationary chamber. In this way, the screen is continually and automatically rotated while the engine is operating.

In addition, the screen may be mounted to a pivotable door which can be opened to access the heat exchangers. To open the door, the endless belt must be declutched or disengaged from the driving sheave before the door can be opened. Such a rotary self-cleaning screen and the declutching assembly as described above, are disclosed in U.S. Pat. Nos. 3,837,149 and 4,233,040, both assigned to the assignee of the present application.

SUMMARY OF THE INVENTION

The present invention is directed to a self-cleaning rotary screen which is provided with an outwardly extending flange having an external groove and an internal groove. The external groove is adapted and constructed to receive an endless belt for rotating the screen; whereas the internal groove is adapted and constructed to receive a plurality of freely rotatable wheels constituting a rotatable bearing assembly for the screen.

To facilitate opening of the pivotable door on which the screen is located, the door is provided with a first and second idler sheaves that are rotatably mounted to the door adjacent to the pivot axis of the door. The centerpoint of the endless belt when coupled to the outer periphery of both sheaves defines a tangent axis that is substantially aligned with the pivot axis. In addition, the center rotational axis of the driving sheave intersects the pivot axis of the idler sheaves. The sheaves are provided with semi-circular grooves which are adapted and constructed to received an endless belt having a circular cross section. In this way, as the door is opened, the endless belt instead of stretching and becoming misaligned from the sheaves, merely twists in the sheaves' grooves thereby eliminating the declutching step necessary with the previous rotary screens.

DETAILED DESCRIPTION

Figure 1:
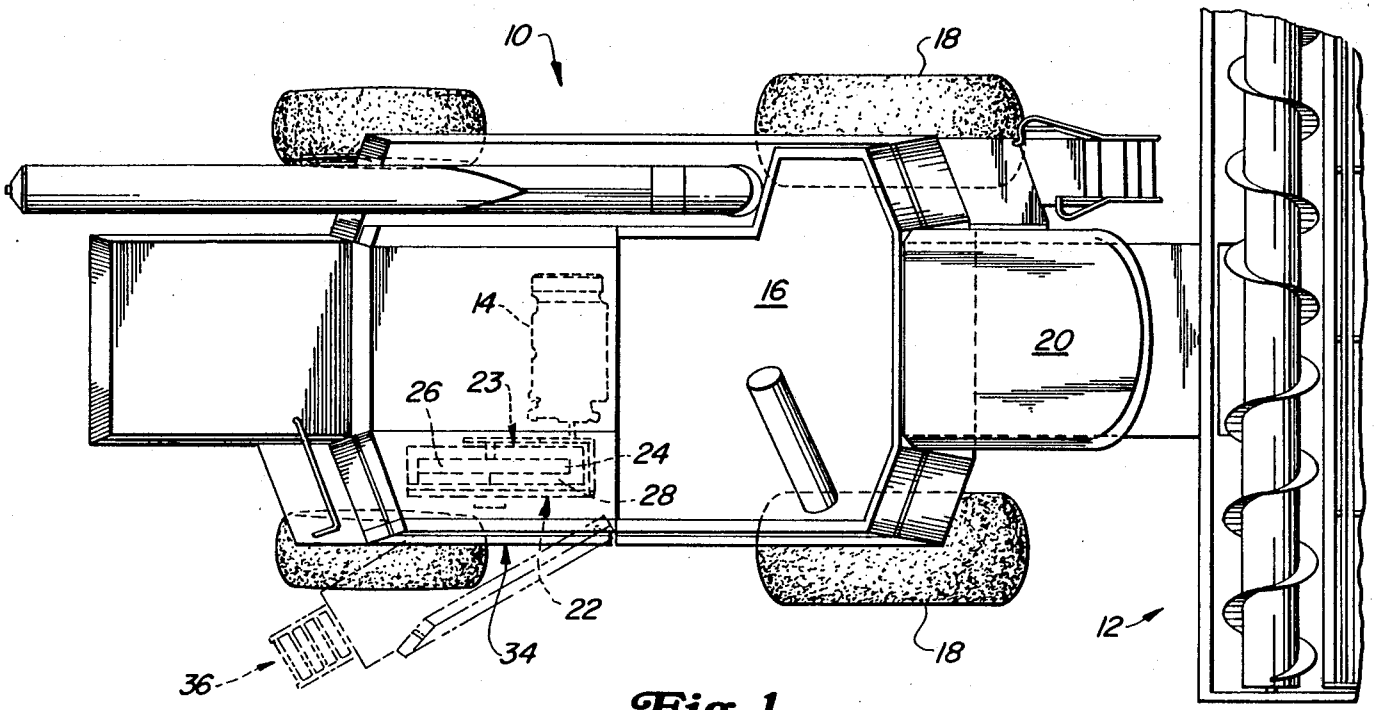
FIG. 1 is an overhead view of an agricultural combine illustrating the location of the engine and the position of the rotary screen.
Figure 2:
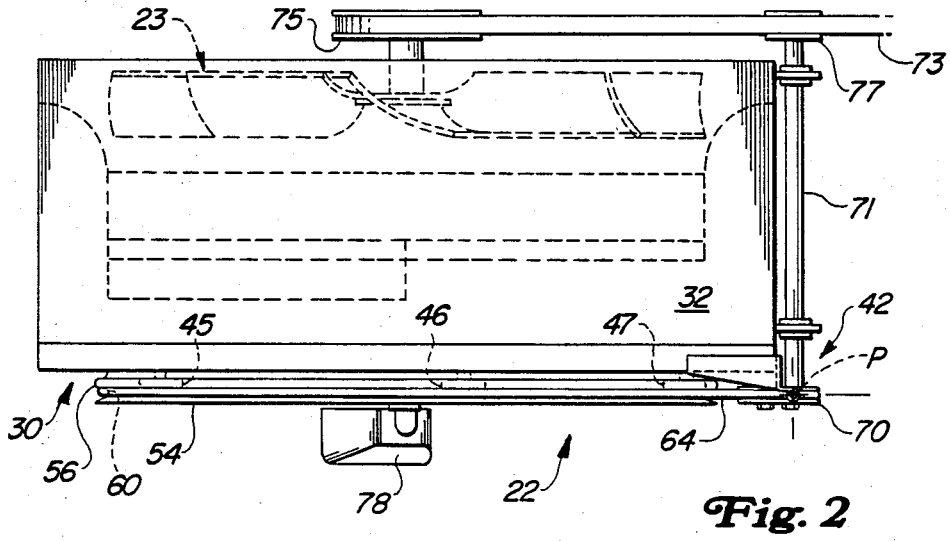
FIG. 2 is a top view of the rotary screen.
Figure 3:
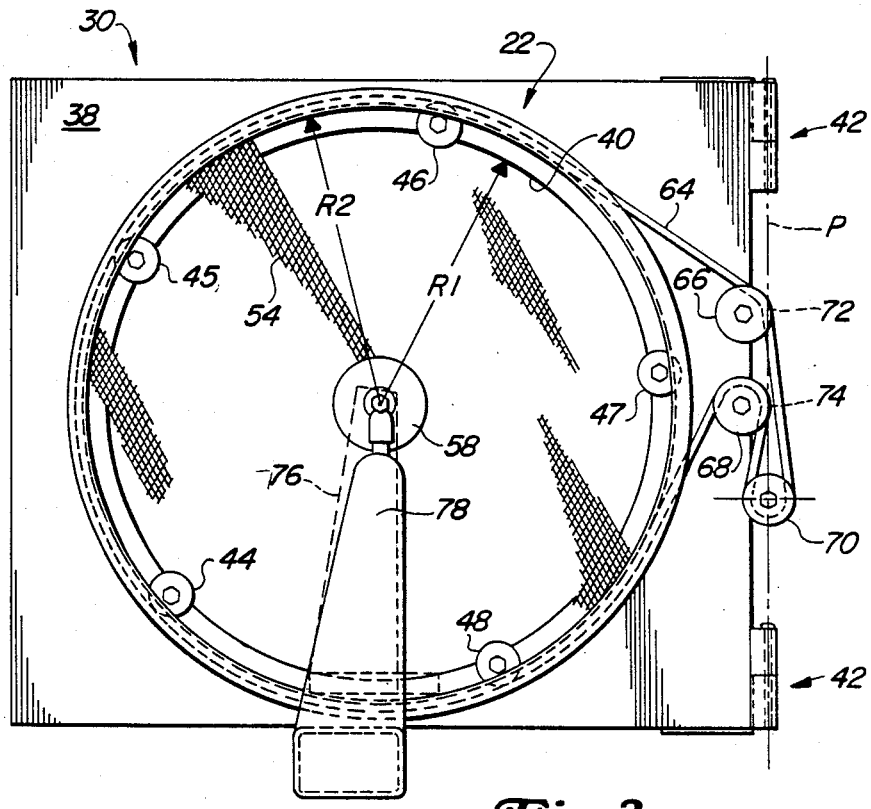
FIG. 3 is a front view of the rotary screen.

FIG. 1 illustrates a self-propelled agricultural combine 10 having a harvesting platform 12. The combine is provided with an engine or propulsion means 14 located behind the clean grain tank 16. The propulsion means provides power to the separator means located inside the combine, the harvesting platform, and the front ground engaging wheels 18. An operator in operator cab 20 controls the operation of the combine. Cooling air for the engine is drawn through rotary screen assembly 22 by fan 23 past heat exchangers 24, 26 and 28. These heat exchangers comprise the radiator for cooling the engine, the oil cooler, and the condenser coils for the air conditioner.

The rotary screen is mounted to a pivotal door 30 pivotally secured to heat exchanger shroud 32 which is fixably mounted to the combine. The pivotal door is provided with hinge 42 for pivoting the door away from shround 32. The pivotable door is located behind louvered side panel 34 of the combine which is also pivotally coupled to the chassis. Side panel 34 is provided with ladder 36 for mounting the combine and servicing the engine.

Pivotable door 30 comprises a rectangular sheet metal plate 38 having a circular opening 40 having a radius R1 which is less than the radius R2 of rotary screen 22. In this way, cooling air passing through opening 40 to the heat exchangers must pass through screen 22. The door is provided with hinges 42 that extend outwardly from the plane of the metal plate. The two hinges from a pivot axis P around which the door is pivoted. The rotary screen is secured to the door by a bearing means comprising five freely rotatable wheels 44, 45, 46, 47 and 48 which are rotatably mounted to the periphery of opening 40 of plate 38 by fixed axle assembly 50 having ball bearings 52.

Figure 4:
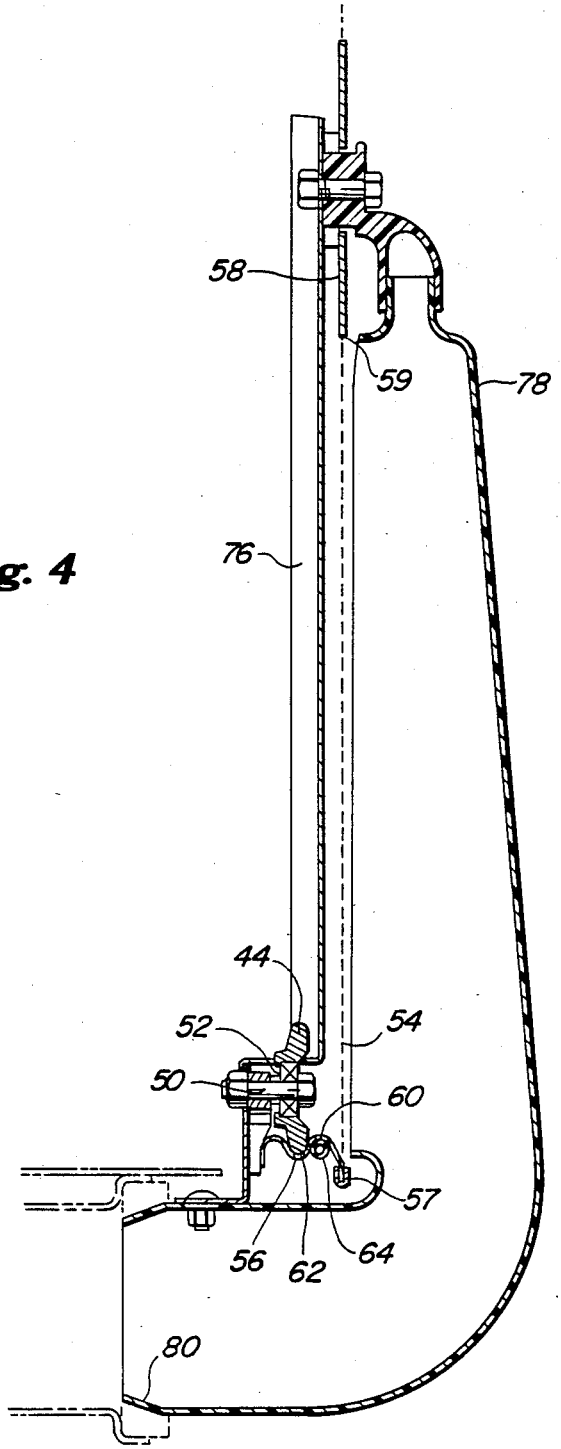
FIG. 4 is a cross sectional view of the rotary screen and stationary chamber.

The screen itself comprises a planar circular screen 54 comprising a woven wire mesh. The screen is secured to outwardly extending perpendicular circular flange 56 at edge 57; and inner mounting ring 58 at 59. The flange is provided with at least one external groove 60 and at least one internal groove 62. As illusstrated in FIG. 4, the rotatable wheels are adapted and constructed to engage internal groove 62 allowing for the rotation of the screen. External groove 60 is adapted and constructed to receive endless belt 64 which is used for transmitting rotational motion to the screen. Belt 64 has a circular cross section and maybe formed out of resilient urethane tubing, such as used in surgical applications.

Extending outwardly from the door are first and second idler sheaves 66 and 68, respectively. Both of these sheaves are freely rotatable and are mounted to the door. Driving sheave 70 comprising a third sheave is operatively coupled to the engine by shaft 71 which is rotatably mounted to shroud 32. Shaft 71 can be rotated by V-belt 73 transmitting rotational movement from fly wheel sheave 75 to shaft sheave 77. Endless belt 64 extends around the screen to first idler sheave 66 where it wraps around the top of this sheave and leaves the sheave at point 72. The belt then wraps around driving sheave 70 and is then directed to second idler sheave 68 at point 74. Points 72 and 74 are located at the outer periphery of the idler sheaves and together form a tangent axis that is substantially aligned with pivot axis P of the door. The points are located at the center of the belt as it leaves or contacts the idler sheaves.

Driving sheave 70 has a central rotational axis that intersects the pivot axis. By arranging the sheaves in this manner, the belt does not become misaligned from the driving sheave, as the door is opened, but rather twists inside the semicircular grooves of the three sheaves.

Extending radially inwardly from the periphery of opening 40 of plate 38 is mounting bracket 76. This mounting bracket provides a central hub to which stationary chamber 78 is secured. The stationary chamber is triangularly shaped and substantially overlies the mounting bracket. The stationary chamber forms a duct that extend around the outer edge of the door terminating in a converging sleeve at 80. This sleeve is adapted and constructed to mate with a duct that is mounted to the chassis and which is pneumatically coupled to the air stream downstream of the heat exchangers. In this way, the air stream downstream of the heat exchangers forms a vacuum, created by fan 23, in the ducts which is in turn pneumatically communicated to the stationary chamber. Chaff and leaves are vacuumed off the rotary screen in the stationary chamber and reintroduced into the air stream downstream of the heat exchangers. Such a system is identical to the ones disclosed in U.S. Pat. Nos. 3,837,149 and 4,233,040, both of which are incorporated herein by reference.

The present invention should not be limited to the above-described embodiment, but should be limited solely to the claims that follow.

We claim:

1. A self cleaning filter screen for filtering out large particulate matter from an air stream, said screen comprising:

a planar screen arranged to intercept an air stream so that air to be filtered flows through the screen;

a circular flange extending outward from the screen, the flange has an internal surface and an external surface, the external surface is provided with an external groove and the internal surface is provided with an internal groove;

a frame on which the screen is rotatably mounted by a bearing means which engages the internal groove; and an endless belt extending about the circular flange in the first external groove, the endless belt is adapted and constructed to transmit rotational motion to the screen and is provided with a cross sectional centerpoint.

2. A filter screen as defined by claim 1 wherein the bearing means comprises a plurality of freely rotatable wheels which are mounted to the frame and which engage the internal groove.

3. A filter screen as defined by claim 2 wherein the frame comprises a pivotable door that is coupled to a larger structure, the door is provided with a circular opening having a radius less than the radius of the circular flange, the screen and flange are adapted and constructed to fit over the opening to prevent unfiltered air from passing through the opening, the pivotable door defines a pivot axis adjacent an edge of the door, first and second freely rotatable sheaves are mounted to the door and are located on the door so that the tangent of the centerpoint of the endless belt when coupled to the outer periphery of both sheaves forms a tangent axis that is substantially aligned with the pivot axis.

4. A filter screen as defined by claim 3 wherein the larger structure is provided with a propulsion means providing a rotational motion through a driving sheave which is mounted to the larger structure and is provided with a central rotational axis that substantially intersects the tangent axis.

5. A filter screen as defined by claim 4 wherein the second sheave is located between the first and driving sheaves along the tangent axis.

6. A filter screen as defined by claim 5 wherein the endless belt that extends around the circular flange extends over the first sheave, around the driving sheave and then over the second sheave, whereby the endless belt passes between the first and second sheaves when passing from the third sheave to the second sheave.

7. A filter screen as defined by claim 6 wherein the endless belt is a resilient belt having a circular cross section.

8. A filter screen as defined by claim 7 wherein the planar screen is provided with an upstream side and a downstream side, the upstream side is provided with a stationary chamber for removing material attached to the screen.

9. A self cleaning filter screen for filtering out large particulate matter from an air stream, said screen comprising:

a filter screen arranged to intercept an air stream so that air to be filtered flows through the screen;

a frame on which the screen is rotatably mounted by a bearing means, the frame comprises a pivotable door that is coupled to a larger structure, the door is provided with an opening having a smaller cross sectional area than the cross sectional area of the filter screen, the filter screen is adapted and constructed to fit over the opening to prevent unfiltered air from passing through the opening, the pivotable door defines a pivot axis adjacent an edge of the door;

an endless belt operatively coupling the filter screen to transmit rotational motion to the screen and is provided with cross sectional centerpoint; and first and second freely rotatable sheaves are mounted to the door and are located on the door so that a tangent of the centerpoint of the endless belt when coupled to the outer periphery of both sheaves forms a tangent axis that is substantially aligned with the pivot axis.

10. A filter screen as defined by claim 9 wherein the larger structure is provided with a propulsion means providing a rotational motion through a driving sheave which is mounted to the larger structure and is provided with a central rotational axis that substantially intersects the tangent axis.

11. A filter screen as defined by claim 10 wherein the second sheave is located between the first and driving sheaves along the tangent axis.

12. A filter screen as defined by claim 11 wherein the endless belt that is operatively coupled to the filter screen extends over the first sheave, around the driving sheave and then over the second sheave, whereby the endless belt passes between the first and second sheaves when passing from the driving sheave to the second sheave.

13. A filter screen as defined by claim 12 wherein the endless belt is a resilient belt having a circular cross section.

14. A self-propelled agricultural combine for harvesting and threshing a crop on a field, the combine comprising:

a chassis having a ground engaging assembly and a propulsion means for propelling the combine across a field;

a harvesting means for collecting a crop from a field extends outwardly from the chassis and is powered by the propulsion means;

a threshing and separating means for separating grain from chaff of a crop harvested from a field is located inside the chassis and is powered by the propulsion means;

a planar filter screen is located adjacent to the propulsion means for filtering large particulate material from cooling air directed to the propulsion means, the filter screen is arranged to intercept a cooling air stream so that air to be filtered flow through the screen, the filter screen is provided with a circular flange having an internal surface and an external surface, the external surface being provided with a first external groove and the internal surface is provided with an internal groove, the filter screen is rotatably mounted to the chassis by a bearing means which engages the internal groove, and an endless belt extending about the circular flange in the first external groove and a propulsion sheave operatively coupled to the propulsion means thereby transmitting rotational motion to the screen.

15. An agricultural combine as defined by claim 14 wherein the bearing means comprises a plurality of freely rotatable wheels which are mounted to the chassis and which engage the internal groove.

16. An agricultural combine as defined by claim 15 wherein the planar screen is provided with an upstream side and a downstream side, the upstream side is provided with a stationary chamber for removing material attached to the screen.

17. A self-propelled agricultural combine for harvesting and threshing a crop on a field, the combine comprising:

a chassis having a ground engaging assembly and a propulsion means for propelling the combine across a field, the propulsion means is also provided with a driving sheave;

a harvesting means for collecting a crop from a field extends outwardly from the chassis and is powered by the propulsion means;

a threshing and separating means for separating grain from chaff of a crop harvested from a field is located inside the chassis and is powered by the propulsion means;

a filter screen is located adjacent to the propulsion means for filtering large particulate material from cooling air directed to the propulsion means, the filter screen is arranged to intercept a cooling air stream so that air to be filtered flows through the screen, the filter screen is mounted on a pivotable door that is pivotally coupled to the chassis and is rotatably mounted to the door by a bearing means, the door is provided with an opening having a smaller cross sectional area than the cross sectional area of the filter screen, the filter screen is adapted and constructed to fit over the opening to prevent unfiltered air from passing through the opening, the pivotable door defines a pivot axis adjacent an edge of the door where it is pivotally coupled to the chassis;

an endless belt operatively couples the driving sheave to the filter screen for rotating the filter screen, the endless belt having a cross sectional centerpoint; and a means for arranging the endless belt so that the endless belt does not have to be operatively disengaged when the pivotable door is opened.

18. An agricultural combine as defined by claim 17 wherein the means for arranging the endless belt comprises first and second freely rotatable sheaves which are mounted to the door and engage the endless belt, the first and second freely rotatable sheaves define an outer periphery located on the door so that the tangent of the centerpoint of the endless belt when coupled to the outer periphery of both sheaves forms a tangent axis that is substantially aligned with the pivot axis, and the driving sheave which is mounted to the chassis and is provided with a center of rotation that lies substantially on the tangent axis.

19. An agricultural combine as defined by claim 18 wherein the second sheave is located between the first sheave and the driving sheave along the tangent axis.

20. An agricultural combine as defined by claim 19 wherein the endless belt that is operatively coupled to the filter screen extends over the first sheave, around the driving sheave and then over the second sheave, whereby the endless belt passes between the first and second sheaves when passing from the driving sheave to the second sheave.

21. An agricultural combine as defined by claim 20 wherein the endless belt is a resilient belt having a circular cross section.

* * * * *